United States Patent [19]

Jones, Sr.

[11] 3,948,516

[45] Apr. 6, 1976

[54] BASKETBALL RIM AND NET STRUCTURE

[76] Inventor: Willie G. Jones, Sr., 1026-26 St., Newport News, Va. 23607

[22] Filed: Apr. 15, 1975

[21] Appl. No.: 568,267

[52] U.S. Cl. ..... 273/1.5 R; 273/55 R; 273/105 R

[51] Int. Cl.[2] ..... A63B 71/00

[58] Field of Search ..... 273/95 R, 95 H, 102.4, 273/105 R, 105 A, 1.5 R, 1.5 A, 127 R, 181 F, 55 R

[56] References Cited

UNITED STATES PATENTS

| | | | |
|---|---|---|---|
| 613,383 | 11/1898 | Morgan | 273/105 R |
| 2,926,879 | 3/1960 | Dietrich | 273/1.5 R |
| 3,680,862 | 8/1972 | Russell | 273/105 R |
| 3,692,072 | 9/1972 | Kohls | 273/105 R |
| 3,761,085 | 9/1973 | Cook | 273/102.4 |
| 3,814,150 | 6/1974 | Gower | 273/105 R |
| 3,822,063 | 7/1974 | Rea | 273/105 R |

*Primary Examiner*—Paul E. Shapiro
*Assistant Examiner*—Marvin Siskind
*Attorney, Agent, or Firm*—Royce E. Jones

[57] ABSTRACT

This invention relates to a net structure having a multiplicity of uses, particularly intended to be used for a variety of games. The net structure consists of an open-centered frame having a net attached thereto with a rim attached to said frame and to said net.

2 Claims, 4 Drawing Figures

BASKETBALL RIM AND NET STRUCTURE

This invention relates to a net structure having a multiplicity of uses, particularly intended to be used for a variety of games. An object of this invention is to provide a novel net structure which will be adaptable to many games.

Another object of this invention is to provide a net structure which can be easily mounted on a variety of support structures, specifically football goal posts.

A further object of the invention is to provide a net device which is inexpensively produced and easily installed for use.

The more specific objects and advantages will become apparent from a consideration of the description taken in connection with the accompanying drawings, illustrating one embodiment of the invention.

Figure 1:
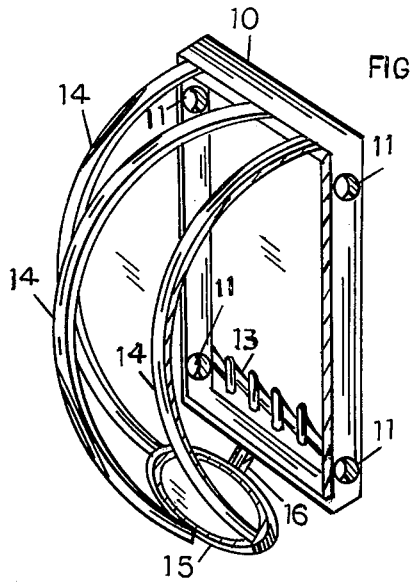
FIG. 1 represents a perspective view of the frame without the attached net of the instant invention.
Figure 2:
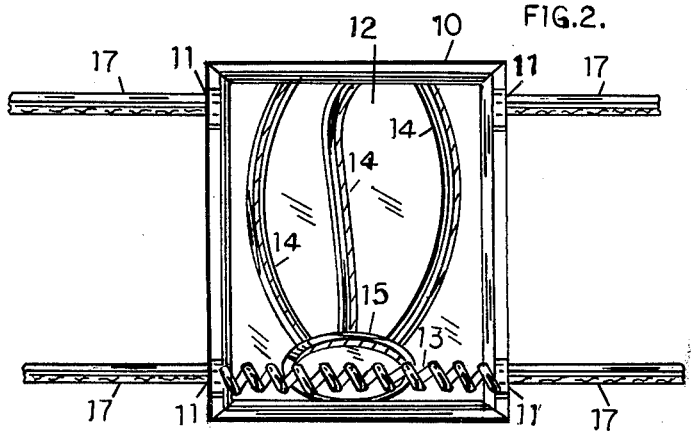
FIG. 2 represents a front view of the frame of FIG. 1.

Referring specifically to the different views, the component parts of the invention are set forth individually as presented in the following description of one embodiment of this invention. In FIGS. 1 and 2 the basic metal rectangular frame 10 of the invention is illustrated. This frame 10 may be made of aluminum or of other appropriate materials. Holes 11 extend through the sides of frame 10 in order that the net structure of the invention may be supported by tying rope supports through the holes 11. The entire center 12 of the frame 10 is open in order that balls or other objects may pass therethrough. Attached to frame 10, near the lower end thereof, is a spring 13 which extends from one side of frame 10 to the other side thereof. Attached to the top member of frame 10 are three flexible thin metal plates 14 which extend from top to bottom and outside of frame 10. Attached to the lower end of plates 14 is a rim 15. Additional plates 14 may be used. Rim 15 is further connected to the bottom member frame 10 by means of a short metal plate 16. Ropes 17 are connected to frame 10 through holes 11, for the purpose of supporting the net structure of this invention in the desired position.

Figure 3:
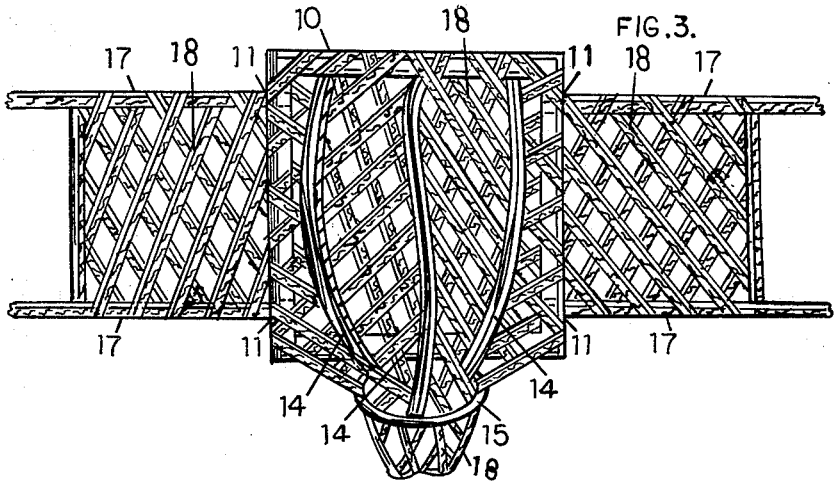
FIG. 3 represents a back view of the net structure of the instant invention detached from any support structure.

In FIG 3, a net 18 is shown in an attached relationship to frame 10, rim 15, plates 14, and ropes 17. A portion of net 18 is connected to and extends below rim 15, similar to a basketball net. The portion of net 18 on the back side of frame 10 acts as a stop to limit the motions of a ball thrown through the opening in frame 10. Portions of net 18 also extend outward from both sides of frame 10 to act as a stop for limiting the trajectory of a ball when thrown against said net.

Figure 4:
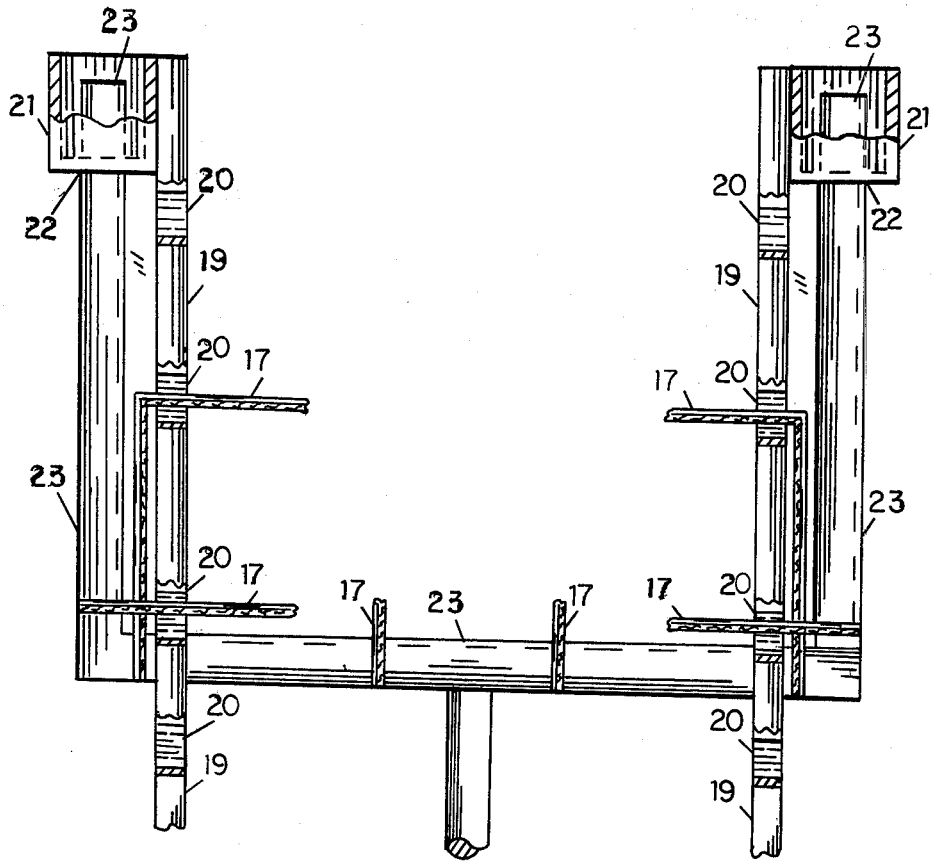
FIG. 4 represents a post structure for supporting the net structure of the instant invention.

The support structure of FIG. 4 consists of metal strip 19 having a series of holes 20 extending therethrough. Attached to the upper ends of strips 19 are caps 21 which have openings 22 therein permitting caps 21 to fit over the upper ends of goal post 23. Ropes 17, extending from casing 10, supporting net 18, pass through holes 20 and around goal post 23 in such a manner as to hold frame 10 and net 18 in the desired position for playing a multiplicity of games. Other types of support structures are deemed to be within the perview of this invention.

In using the frame 10 with attached net 18 as set forth herein, a ball thrown through frame 10 will strike net 18 and then fall through rim 15 and the portion of net 18 extending below rim 15. If a ball is thrown toward frame 10 with such a trajectory that it strikes spring 13, it will be thrown or rejected from the frame area.

Other designs and arrangements of parts is seen to fall within the perview of this invention.

Having thus described the invention, what is claimed as being new is:

1. A net structure consisting of a rectangular frame, thin metal plates attached to the top member of said frame and extending downward therefrom, a rim attached to the lower end of said metal plates, said rim being further attached to the frame by means of a short metal plate which extends from the bottom member of the frame, said frame, plates, and rim having a net connected thereto, said net being the heighth of the frame and connected to the back of the frame and directly to the plates, and extending downward from the rim, said frame further having ropes attached thereto through holes in the sides thereof, said net being connected to the ropes as well as to the frame, plates, and rim, said frame further having a spring member attached to both sides thereof in such a position that the spring extends across the lower portion of said frame.

2. The net structure of claim 1 further limited in that said net extends outward from both sides of said frame as a stop for limiting the trajectory of a ball thrown against said net.

* * * * *